US006369765B1

(12) United States Patent
Davis

(10) Patent No.: US 6,369,765 B1
(45) Date of Patent: Apr. 9, 2002

(54) METHOD AND APPARATUS FOR REDUCING ELECTROMAGNETIC RADIATION EMISSION

(76) Inventor: Lisa Davis, 3 Christopher Pl., Saddle River, NJ (US) 07458

( * ) Notice: Subject to any disclaimer, the term of this patent is extended or adjusted under 35 U.S.C. 154(b) by 0 days.

(21) Appl. No.: 09/573,653

(22) Filed: May 18, 2000

Related U.S. Application Data

(60) Provisional application No. 60/135,245, filed on May 21, 1999.

(51) Int. Cl.[7] ..... H01Q 1/24
(52) U.S. Cl. ..... 343/702; 250/504 R
(58) Field of Search ..... 343/702; 455/90; 250/504 R, 505.1; 219/405

(56) References Cited

U.S. PATENT DOCUMENTS 5,898,180 A * 4/1999 Venkataramani et al. ... 250/504 R
6,025,805 A * 2/2000 Smith et al. ..... 343/702
6,207,077 B1 * 3/2001 Burnell-Jones ..... 252/301.36

* cited by examiner

*Primary Examiner*—Hoanganh Le
*Assistant Examiner*—James Clinger
(74) *Attorney, Agent, or Firm*—Frishauf, Holtz, Goodman, Langer & Chick, P.C.

(57) ABSTRACT

An antenna for use with a cellular telephone includes a conductive wire having a binder disposed thereover. The conductive wire may be entirely shaped in the form of a coil or only partially shaped like a coil. The binder is preferably a polymeric material which is clear and transparent. The binder includes a quartz crystal powder, reflective flecks such as mylar, and a fluorescent dye dispersed therein. The binder is applied over the conductive wire and reduces emissions of electromagnetic radiation.

28 Claims, 8 Drawing Sheets

SAR (1g):2.17 mW/g,
SAR (10g):1.37 mW/g

GENERIC TWIN PHANTOM; LEFT HAND_X SECTION;
POSITION: (80°,65°); FREQUENCY: 837 MHz;
PROBE: ET3DV5−SN1333; ConvF
(6.03,6.03,6.03); CREST FACTOR; 1.0; BRAIN 835
MHz: =0.76 mho/me =46.1p =1.00 g/cm3
CUBE 5X5X7: (WORST−CASE EXTRAPOLATION)
COARSE: Dx=20.0, Dy=20.0, Dz=10.0
POWERDRIFT: −0.01 dB GENERIC TWIN PHANTOM; LEFT HAND_X SECTION;
POSITION: (80°,65°); FREQUENCY: 837 MHz;
PROBE: ET3DV5−SN1333; ConvF
(6.03,6.03,6.03); CREST FACTOR; 1.0; BRAIN 835
MHz: =0.76 mho/me =46.1p =1.00 g/cm3
CUBE 5X5X7: (WORST−CASE EXTRAPOLATION)
COARSE: Dx=20.0, Dy=20.0, Dz=10.0
POWERDRIFT: 0.03 dB GENERIC TWIN PHANTOM; LEFT HAND_X SECTION;
POSITION: (80°,65°); FREQUENCY: 837 MHz;
PROBE: ET3DV5−SN1333; ConvF
(6.03,6.03,6.03); CREST FACTOR; 1.0; BRAIN 835
MHz: =0.76 mho/me =46.1p =1.00 g/cm3
CUBE 5X5X7: (WORST−CASE EXTRAPOLATION)
COARSE: Dx=20.0, Dy=20.0, Dz=10.0
POWERDRIFT: −0.15 dB GENERIC TWIN PHANTOM; LEFT HAND_X SECTION;
POSITION: (80°,65°); FREQUENCY: 837 MHz;
PROBE: ET3DV5−SN1333; ConvF
(6.03,6.03,6.03); CREST FACTOR; 1.0; BRAIN 835
MHz: =0.76 mho/me =46.1p =1.00 g/cm3
CUBE 5X5X7: (WORST−CASE EXTRAPOLATION)
COARSE: Dx=20.0, Dy=20.0, Dz=10.0
POWERDRIFT: −0.01 dB

METHOD AND APPARATUS FOR REDUCING ELECTROMAGNETIC RADIATION EMISSION

CROSS-REFERENCE TO RELATED APPLICATION

This application claims priority under 35 USC 119 of U.S. Provisional Application Ser. No. 60/135,245 filed May 21, 1999, the entire disclosure of which is incorporated herein by reference.

FIELD OF THE INVENTION

The present invention is directed to reducing electromagnetic radiation emissions from electronic devices, and more particularly to reducing the exposure of a user of an electronic device to electromagnetic radiation.

BACKGROUND INFORMATION

Many electronic devices in use today emit electromagnetic radiation. Prolonged exposure to electromagnetic radiation is believed to cause certain illnesses, most notably cancer. It has also been determined that extended exposure to electromagnetic radiation, especially that generated by cellular telephone antennas, breaks single and double DNA strands in brain cells, reduces REM sleep (which is necessary for information processing in the brain), causes short term memory loss, and compromises the blood-brain barrier (the blood-brain barrier prevents the brain from toxic compounds, stabilizes and optimizes the viable fluids surrounding the brain).

One solution for limiting user exposure to electromagnetic radiation without reducing the use of electronic devices such as cellular telephones is to construct the electronic device so that the amount of electromagnetic radiation which reaches the user of the device is reduced. This has been accomplished in the past using a variety of shields. Shields have been used with and/or have been incorporated into electronic devices such as, for example, computers, cellular telephones, building materials, and antennas for wireless communications devices.

While limiting exposure to electromagnetic radiation, shields have certain disadvantages. The inclusion of a shield adds to the cost and weight of the device, alters the size and shape of the device, and/or makes the device bulky and inconvenient to use. Shields may also significantly negatively affect the performance of the electronic device. Typical shields include those disclosed in U.S. Pat. No. 5,726,383 to Geller, et al., U.S. Pat. No. 5,335,366 to Daniels, and U.S. Pat. No. 5,657,386 to Schwanke. The known devices are deficient in that they are not a lightweight, flexible, and adjustable way of reducing electromagnetic radiation emissions without significantly impacting the cost and/or performance of the electronic device.

OBJECTS AND SUMMARY OF THE INVENTION

It is therefore an object of the present invention to provide a method and apparatus which overcomes the drawbacks of the prior art methods and apparatus for reducing user exposure to electromagnetic radiation generated by, for example, cellular telephones and their antennas.

In accordance with one form of the present invention, an article for reducing exposure to electromagnetic radiation includes a binder having crystal powder and reflective flecks dispersed therein. The invention uses crystalline material, reflective material and fluorescent material, in combination to reduce the exposure of a user to electromagnetic radiation. These materials are distributed in a binder such as a polymer. The binder may be fluorescent and, in that case, no additional fluorescent material may be required. Other elements can further enhance the level of protection realized.

In one embodiment, the present invention is provided in the form of an antenna for cellular telephones and similar communication devices. The antenna is constructed using a molded binder of polymeric material having crystal powder, reflective "flecks," and fluorescent dye dispersed therein. A conductive wire extends in the polymeric material and is connected to a source of communication signals. This antenna preferably achieves a Specific Absorption Rate ("SAR") which meets the U.S. Federal Communications Commission ("FCC") guidelines when used with a cellular telephone.

The polymeric binder material could also be used to overcoat an existing antenna structure, either by being coated thereon or by being formed into a sleeve and slipped over the existing structure.

The fluorescent material may comprise a fluorescent dye or the binder itself may comprise a fluorescent material, in which case, the fluorescent dye may or may not be necessary. The binder may comprise a polymeric material and is preferably clear and transparent.

The crystal powder used may comprise a powder of any organic crystalline material and is preferably crystal quartz powder made from quartz crystal which may be preprogrammed with a specific frequency. The reflective flecks may comprise mylar glitter. The conductive wire, provided for receiving and transmitting communications signals, may have a linear shape or may comprise a coil of wire. The conductive wire is preferably comprised of copper alloys such as steel-copper and tin-copper alloys.

The antenna preferably includes a binder having 0.1% to 10.0% by weight crystal powder, 0.1% to 10.0% by weight reflective flecks, and 0.005% to 5.0% by weight fluorescent dye. Other elements which may be included in the device are a bulb of mercury disposed at one end of the antenna, a magnet and a crystal, included in the binder in any combination. The magnet may comprise a cobalt-samarium magnet and the crystal may comprise an inorganic quartz crystal which can be tuned to oscillate at a specific frequency.

A preferred form of the method and apparatus for reducing electromagnetic radiation emission, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
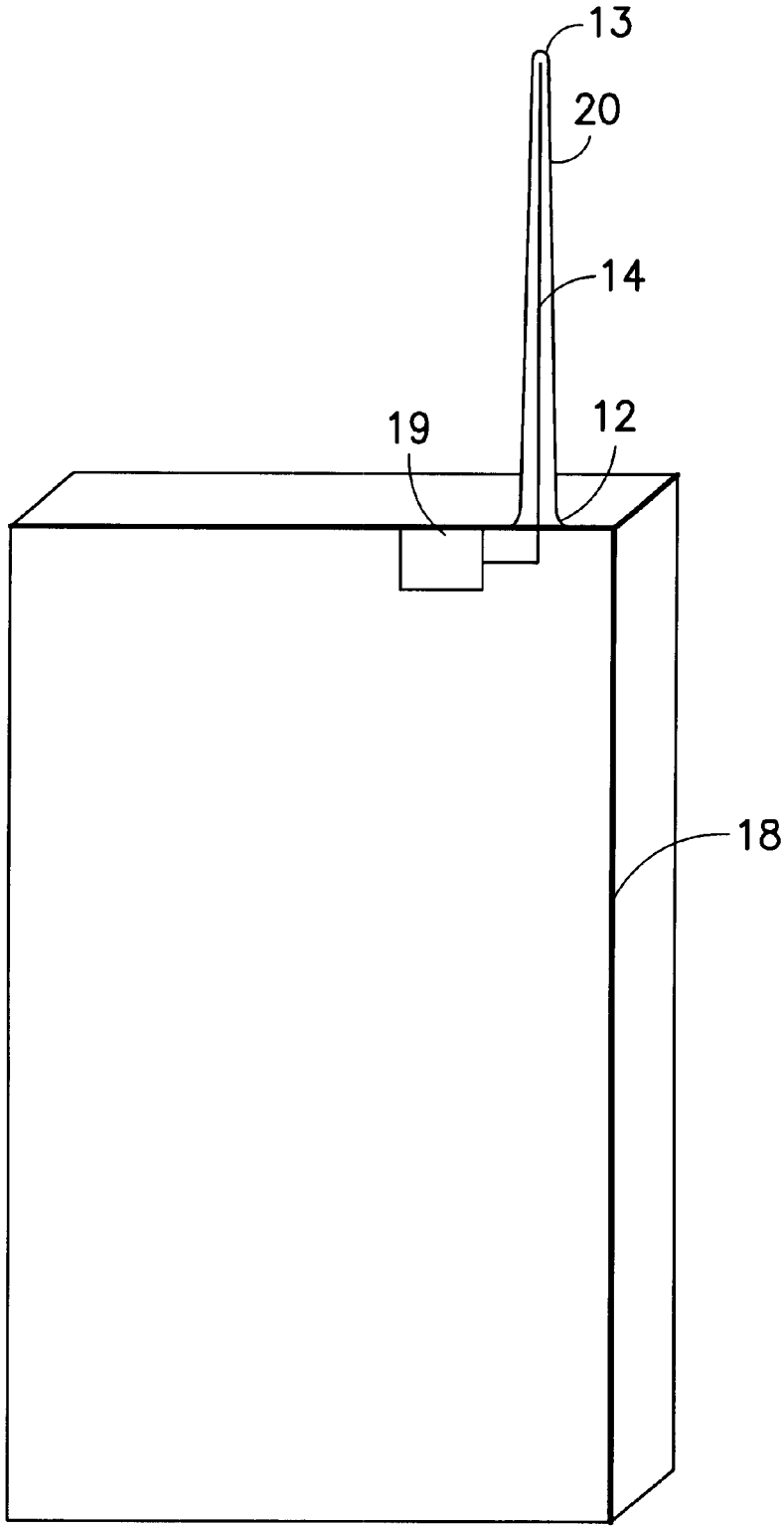
FIG. 1 is a perspective view of a cellular telephone having an antenna.

The present invention is directed to a compound and article for lessening a user's exposure to electromagnetic radiation from an electronic device, and to reducing emissions of electromagnetic radiation from electronic devices. The compound preferably includes a binder having distributed therein crystalline powder (e.g., quartz crystal or diamond dust), small pieces or "flecks" of reflective material (e.g., mylar glitter), and a fluorescent material (e.g., fluorescent dye). The binder may be a polymer. The polymer may be fluorescent and, in that case, additional fluorescent material may not need to be added thereto.

The binder may comprise a polymeric material, including resin, silicone, rubber, paint, glue, or any other material with which the crystalline powder and reflective material (reflective flecks) may be mixed, bound and retained. The binder is preferably clear and transparent. The binder may, however, have any color, including black and may be opaque or non-light transmissive (non-translucent). The binder may be a liquid or solid, although it is preferable that the binder be a liquid during preparation so that the crystalline powder, reflective material and fluorescent dye can be readily mixed therein. A preferred binder is Surlyn™ which is manufactured by the DuPont Corp. While Surlyn™ grade 8940 is preferred for use as the binder, Surlyn™ grade 8150, inter alia, can also be used. It is also known that flexible PVC and K-resin can be employed as the binder. Even though flexible PVC and K-resin are clear which has been identified as an important characteristic of the binder which is used, flexible PVC and K-resin are more difficult to work with than Surlyn and are therefore not preferred.

The reflective flecks comprise pieces of reflective material such as metal or plastic having a metallic coating. The reflective flecks preferably include conductive material, such as metal or conductive polymer. Pieces of mylar having aluminum deposited thereon may also be used. The reflective material used in holograms is preferred as it withstands heat such as that applied during some types of molding. Of course, where the final product is not molded or where other types of polymers such as UV-curable resins and the like are used, one need not worry about heat exposure and other reflective materials can be used. The amount of reflective flecks used may range from between about 0.1% to about 10.0% by weight of the finished formulation and more preferably, between about 0.1% and about 1.0%. Most preferably, the reflective flecks are provided in an amount of about 0.3% by weight of the finished formulation.

As previously stated, the compound preferably has a fluorescence. If the binder is not already fluorescent, a fluorescent material or dye may be added. If a fluorescent dye is used, the dye preferably mixes with the binder without affecting the clarity and transparency of the binder. In the preferred embodiment, the fluorescent dye fluoresces a clear, blue-white light and preferably includes a non-yellowing factor. If a fluorescent material such as a fluorescent dye is used, it is provided in an amount which ranges from between about 0.005% and about 5.0% by weight of the finished formulation. More preferably, the dye is provided in an amount of between about 0.005% and about 1.0% of the finished formulation. Most preferably, the dye is provided in an amount of about 0.01% by weight of the finished formulation. A preferred fluorescent dye is Uvitex OB manufactured by Ciba Specialty Chemical Co. of Tarrytown, N.Y. This fluorescent dye is preferred because it does not affect the clarity and light transparency of the binder.

As stated above, the compound preferably includes a crystalline powder. The crystalline powder may include any crushed material having a crystalline structure, including soft materials like talc and hard materials like diamonds. The crystalline power may also be a mineral. In the preferred embodiment, quartz crystal powder is used, and most preferably, clear organic quartz crystal powder is used. Crystal powders having a wide range of grain-sizes may be used. The amount of crushed crystal used may range from between about 0.1% to about 10.0% by weight of the finished formulation and more preferably between about 0.1% and about 1.0%. Most preferably, the crystal powder is provided in an amount of about 0.2% by weight of the finished formulation. A suitable and preferred quartz crystal is 99% crystal quartz powder sold by Crystal Works, Inc. of Bend, Oreg.

In the preferred embodiment, the compound 10 includes binder (Surlyn™ 8940) having about 0.2% by weight crystal powder, about 0.3% by weight mylar glitter, and about 0.01% by weight fluorescent dye dispersed throughout. While the fluorescent dye is preferred because it provides better reduction of electromagnetic radiation emissions, it need not be present to reduce electromagnetic radiation emissions.

Articles produced using the invention may include, for example, an antenna for cellular phones, as depicted in FIG. 1.

The compound 10 (including the materials discussed above) is preferably molded using conventional molding techniques, such that it covers a coil of wire 14 (suitable for use as a transmitter/receiver antenna) wound in a counter-clockwise direction from the base 12 of the antenna 20 to the tip 13 of the antenna. The coil of wire may comprise metal alloys such as tin, cooper, steel, silver, titanium and aluminum. In the preferred embodiment copper clad music wire (a high tension carbon steel wire) is employed having a diameter of 0.04". This wire is preferred because it is durable (i.e., it does not easily break when manipulated). A suitable copper clad music wire (a high tension carbon steel wire) is manufactured by Copper Weld, Inc. of Fayetteville, Tenn.

The purpose of the coil of wire is to send and receive communications signals. The end of the wire 14 adjacent the base 12 extends to or is connectable to a transceiver 19 or other electronic device within the cellular telephone 18 for sending and receiving communications signals. The power output of cellular telephones when sending signals is a maximum of about 600 Milliwatt to two or three Watts, depending on the type of the device. It is foreseen that the wire 14 could be a shape other than a coil such as a straight wire. Depending upon the design of the cellular telephone, the coil of wire and general shape of antenna 20 may vary significantly.

Figure 2A:
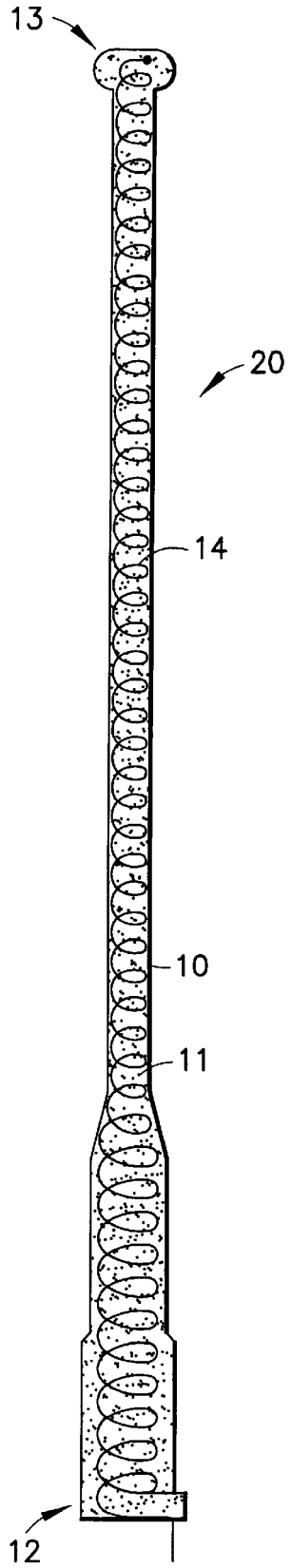
FIG. 2A is a partial cut-away view of a cellular telephone antenna according to the present invention.

Referring now to FIG. 2A, a preferred form of the cellular telephone antenna 20 in accordance with the present invention is shown. As depicted in FIG. 2A, the antenna is broader in cross-section at the base 12 than the tip 13. The coil of wire is coated with the compound such that a layer of compound about 0.02" thick is coated over the wire. Preferably the compound is also dispersed within the interior of the turns of the coil to provide a solid object which maintains its structural integrity. In the preferred embodiment, the antenna only includes the wire surrounded (either coated or molded) by the compound.

Figure 2B:
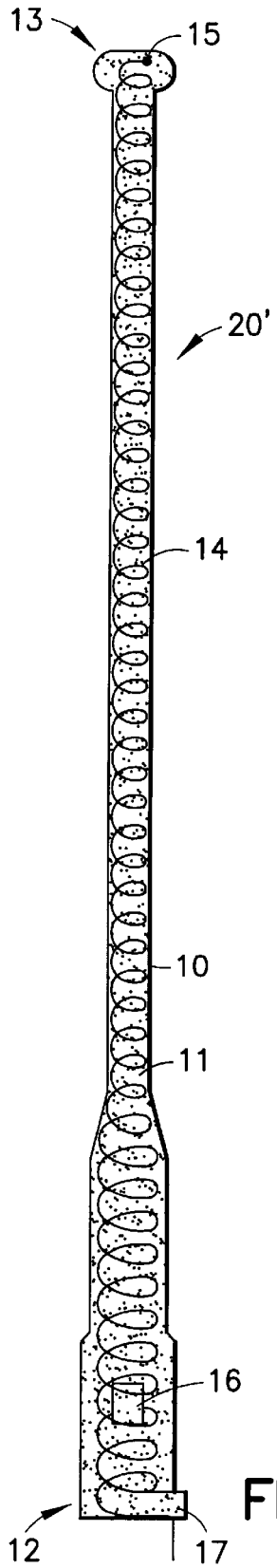
FIG. 2B is a partial cut-away view of a cellular telephone antenna according to another embodiment of the present invention.

In an alternative embodiment shown in FIG. 2B (which includes the compound set forth in connection with FIG. 2A), the antenna 201 includes a bulb of mercury 15 attached at the end of the copper coil adjacent the tip 13 of the antenna. The bulb of mercury preferably has a diameter of about 0.04", although the bulb of mercury could be larger or smaller (0.004" to 0.1"). The antenna 20' of the alternative embodiment also includes, proximate the antenna base 12 but spaced from the body of the cellular telephone, a magnet 16. The magnet may be a cobalt/samarium magnet or other magnetic material and preferably has a circular shape with a diameter of about 0.1" and a height of about 0.08". A larger or smaller magnet with different dimensions would also be acceptable. The size of the magnet was chosen because it would fit within the turns of the coil of the antenna. The preferred magnet is a cobalt/samarium magnet sold by Dexter Magnets of Dexter, Calif. The magnet is preferably disposed within the interior of the coils of wire 14 and embedded within the compound 10. Cobalt/samarium is preferred for its strong magnetic qualities. Proximate the antenna base 12, a crystal, preferably a painted fluorescent green quartz crystal 17, is disposed. The crystal is preferably surrounded by the compound 10. The crystal is interposed between the magnet 16 and the antenna base 12 and is preferably about 3 mm×3 mm×1 mm in size. The quartz crystal 17 may be an inorganic precut quartz crystal preprogramed to frequencies between 150 MHZ to 300 MHZ and painted with light lime-green fluorescent paint. Quartz crystals having a higher or lower frequency may be used. The compound is preferably applied over the coil of wire which includes the mercury, magnet and quartz crystal such that the wire, mercury, magnet and quartz crystal are covered by and embedded within the compound.

Figure 3:
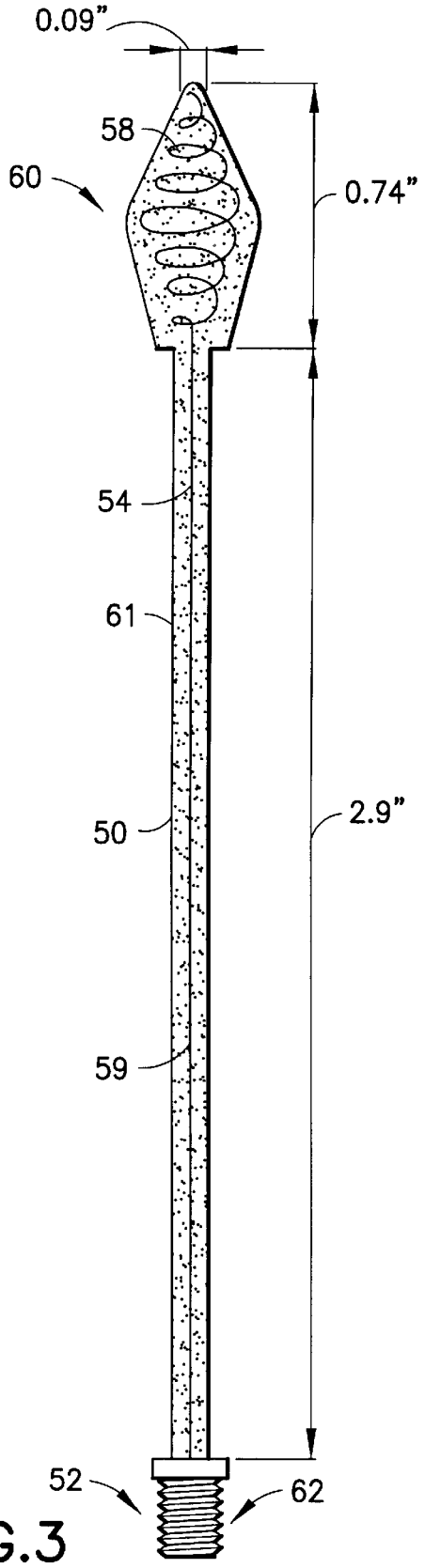
FIG. 3 is a partial cut-away view of a cellular telephone antenna according to another embodiment of the present invention.

Another embodiment of the invention is depicted in FIG. 3, which illustrates another antenna 60 for a cellular telephone. The compound 50 has substantially the same composition as the compound 10 indicated above in connection with FIGS. 2A and 2B. The antenna has an elongated portion 61 having a base 52 at one end for connection to a cellular telephone, and a bulb portion 60 at the tip or other end of the antenna. The bulb portion 60 has a cross-sectional shape (perpendicular to its axis) which is relatively narrow at a first end joining the elongated portion 61 of the antenna, a medial portion which is broader than the first end, and a second end at the tip of the antenna which is also relatively narrow. The second end preferably has a cross-sectional width of 0.09 inches.

An uncoiled portion 59 of wire 54 extends from the base 52 to the first end of the bulb portion 60. The uncoiled portion 59 extends linearly and coaxial with the elongated portion 61. From the first end of the bulb 60 to the second end of the bulb, the wire is shaped in a coiled pattern 58. The coiled pattern 58 has a broader medial region corresponding to the shape of the bulb 60.

The elongated portion shown in the embodiment of FIG. 3 is preferably 2.9 inches in height and the bulb 60 is preferably 0.74 inches. The antenna also preferably has a threaded portion 62 at the base 52 for connection to a cellular phone.

The antenna in accordance with the embodiment shown in FIG. 3 includes the compound having the reflective flecks, crystal powder and fluorescence as discussed in connection with FIGS. 2A and 2B. The quartz crystal at the base of the antenna, bulb of mercury, and the magnet adjacent the base of the embodiment shown in FIG. 2B are not included in the embodiment of FIG. 3. The quartz crystal, bulb of mercury and magnet included in the embodiment of FIG. 2B are not necessary to effect a substantial reduction in the electromagnetic radiation emitted by a cellular telephone antenna, but may be included as required, depending upon the electronics of the telephone to which the antenna is attached.

An antenna in accordance with the present invention may be used with any communication device such as transmission and receiving devices and transducers, including hand-held communication devices and communication devices carried on the human body. The hand-held devices are generally less than one foot long and are held adjacent a person's head. One example is a "walkie-talkie". Another example is a conventional cellular telephone. As used in this disclosure, the expression "person-carried transmitter" refers to a transmitter which can be handheld or worn on the human body about a wrist, or hooked to a person's clothing, or worn by a user in some other manner.

In order for the above-identified binder and the antennas constructed using the binder to be most effective in reducing the amount of electromagnetic radiation emitted by an electronic device, the article (i.e., the cellular telephone antenna which includes the compound) must undergo a "programming" process. That is, the cellular telephone antenna must be exposed to low frequency ultraviolet light. As a result of the programming of the cellular telephone antenna, the antenna absorbs and/or reflects specific color beams of light which combine with the electromagnetic radiation emitted from the antenna. The color beams of light absorbed/reflected by the antenna combine with the electromagnetic radiation emitted from the antenna in such a way to substantially convert the electromagnetic radiation into a harmless color flare in the $18^{th}$ harmonic band. This is accomplished while still permitting transmission of cellular communication signals from the antenna with satisfactory signal quality and signal strength.

The method of programming the cellular telephone antenna includes exposing each antenna to be programmed to a low frequency ultraviolet light source. In the preferred embodiment, a filter is interposed between the low-frequency ultraviolet light source and the cellular antenna being programmed. The light filter includes a light transmissive sheet (e.g., a polymer, plastic or resin sheet). The sheet also has a vibrational frequency number etched or engraved onto the sheet. Thereafter, a fluorescent dye is applied thereto. The fluorescent dye effectively amplifies the engraved specific vibrational frequency number. The dye is preferably an invisible fluorescent dye which is rubbed onto the etched vibrational frequency number (plastic sheet). A suitable dye is Uvitex OB because it does not cause the plastic sheet to bubble, and does not effect the light transmissiveness of the plastic sheet. In the preferred embodiment the vibrational frequency number etched into the plastic sheet is 000.3768935.4289. The ultraviolet light passes through the plastic sheet including the etched vibrational frequency number and burnishes the antenna with the vibrational frequency such that the antenna will absorb a specific frequency of light which, when combined with the electromagnetic radiation emitted by the antenna, substantially reduces the amount of measured electromagnetic radiation emission.

Figure 8:
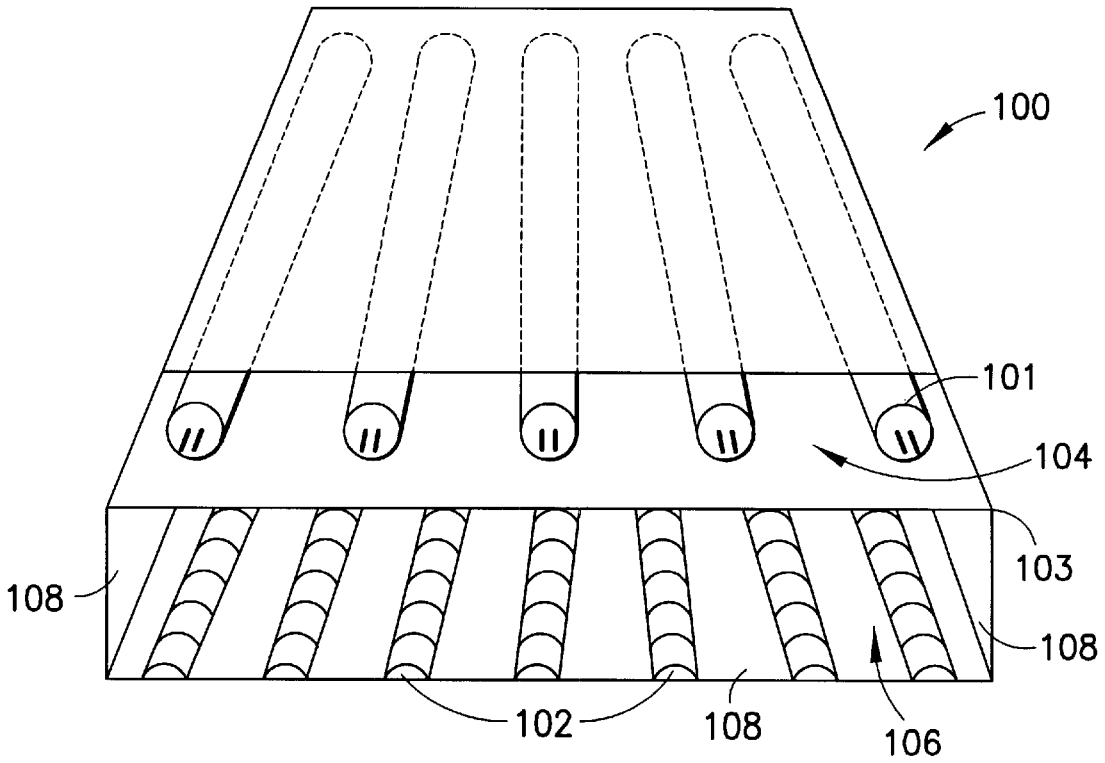
FIG. 8 is a perspective view of an apparatus for programming the cellular telephone antennas built in accordance with the present invention.

In one embodiment of the invention shown in FIG. 8, an ultraviolet box 100 is proposed for programming the cellular telephone antennas 102. The box preferably includes first and second chambers 104, 106 wherein the first chamber is disposed above a second chamber. The first chamber houses the ultraviolet light source 101. The first and second chambers are separated by the light transmissive sheet 103 which includes the vibrational frequency number engraved thereon and the fluorescent dye. The interior walls of the ultraviolet box are preferably coated with aluminum 108 (or other reflective material) such that the interior of the ultraviolet box will reflect light rays present therein. The reflective nature of the interior of the box enables a more efficient use of the ultraviolet light source. In the present embodiment, the cellular telephone antennas 102 are spaced approximately 8 inches from the low frequency ultraviolet light sources 101 and the antennas are exposed to the ultraviolet light source for at least 20 seconds. Exposure of the cellular telephone antennas to the ultraviolet light source for less than 20 seconds does not provide the best results. Exposure for more than 20 seconds does not appear to enhance the electromagnetic radiation reduction of the cellular telephone antenna.

It has been shown that the cellular telephone antenna constructed in accordance with the present invention does reduce electromagnetic radiation emissions without having been exposed to the treated ultraviolet light (i.e., the antenna could be unexposed to the low frequency ultraviolet light source or exposed to untreated low frequency ultraviolet light). However, the effectiveness of the cellular telephone antenna is greatest when the antenna is exposed to the low frequency ultraviolet light as described above.

Testing of the cellular telephone antenna constructed in accordance with the present invention indicates that the Specific Absorption Rate ("SAR"), measuring exposure of humans to radio frequency fields, met the U.S. Federal Communications Commission's ("FCC") guidelines for wireless communications devices. The results of such testing, conducted by Intertek Testing Services ("ITS"), are illustrated in FIGS. 4 through 7.

Figure 4:
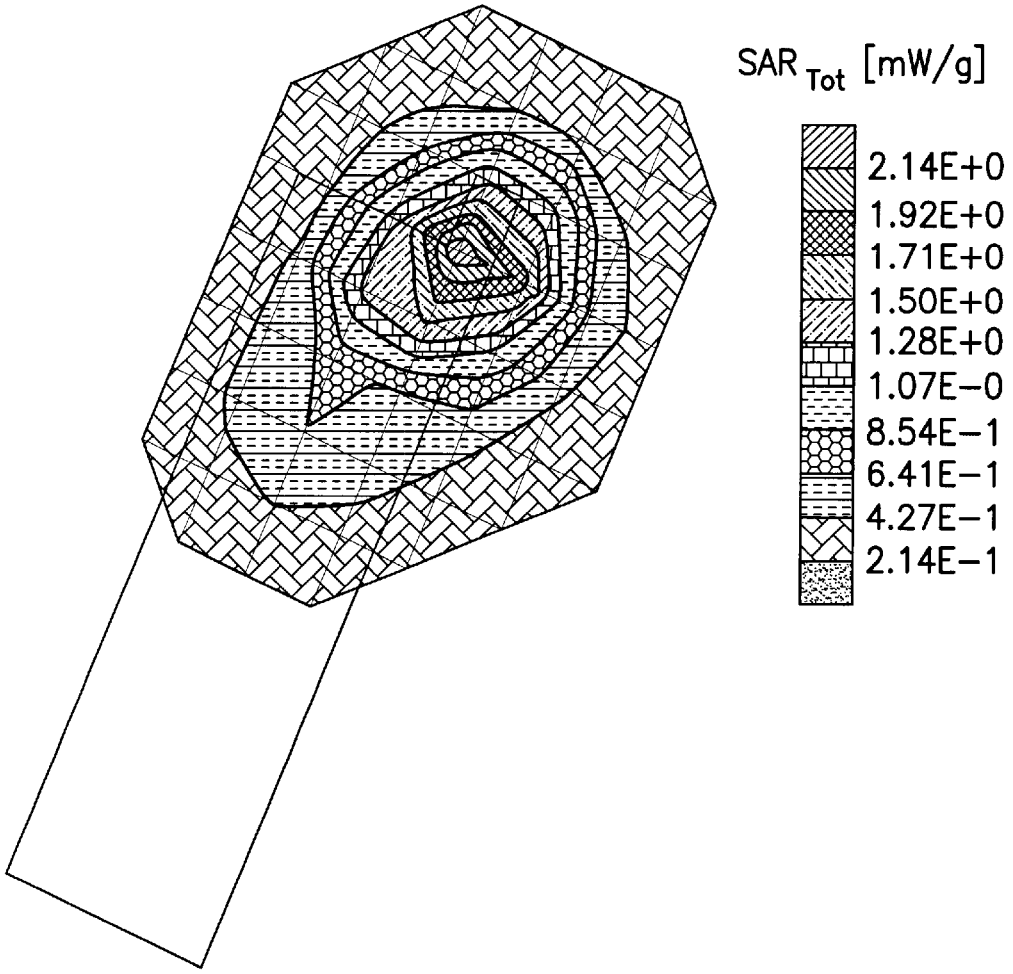
FIG. 4 illustrates the Specific Absorption Rate (SAR) for a Motorola MicroTAC cellular telephone equipped with a stock antenna.
Figure 5:
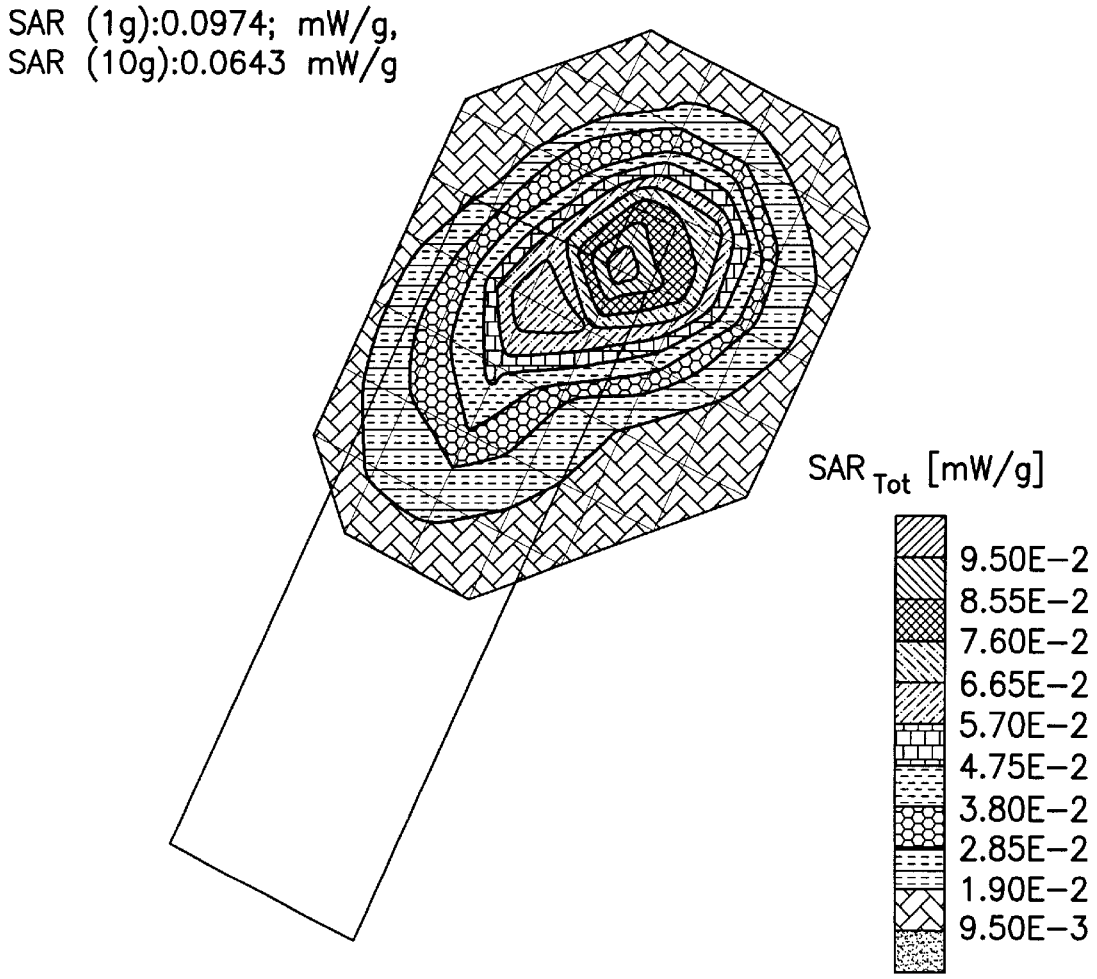
FIG. 5 illustrates the Specific Absorption Rate (SAR) for a Motorola MicroTAC cellular telephone equipped with an antenna built in accordance with the present invention.

FIGS. 4 and 5 illustrate the SAR locations on a particular type cell phone. FIG. 4 shows an SAR (1 g) of 2.17 mW/g for a MicroTAC phone equipped with a stock antenna, whereas FIG. 5 shows an SAR (1 g) of 0.0974 mW/g for the same phone equipped with an antenna constructed in accordance with the present invention.

Figure 6:
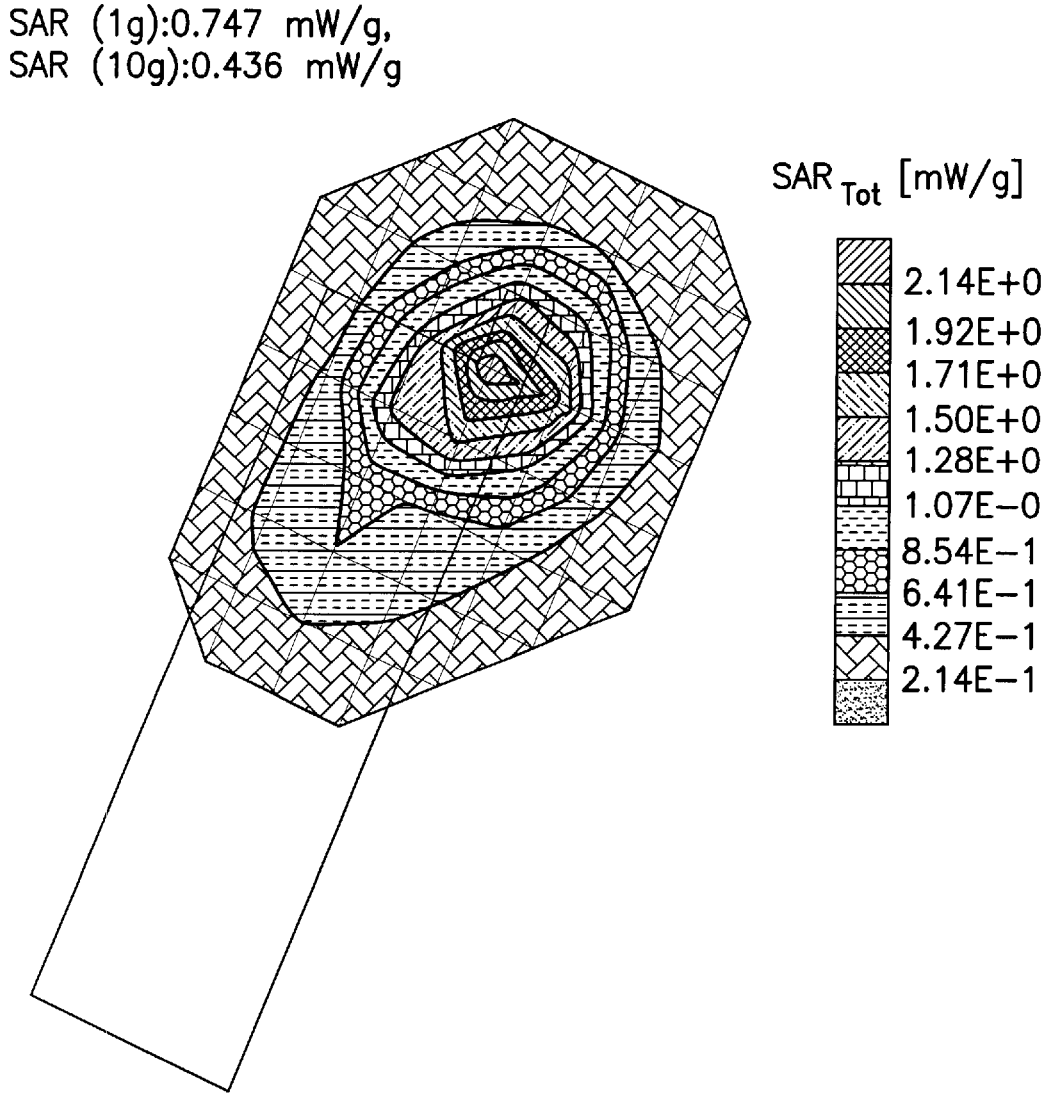
FIG. 6 illustrates the Specific Absorption Rate (SAR) for a Motorola StarTAC cellular telephone equipped with a stock antenna.
Figure 7:
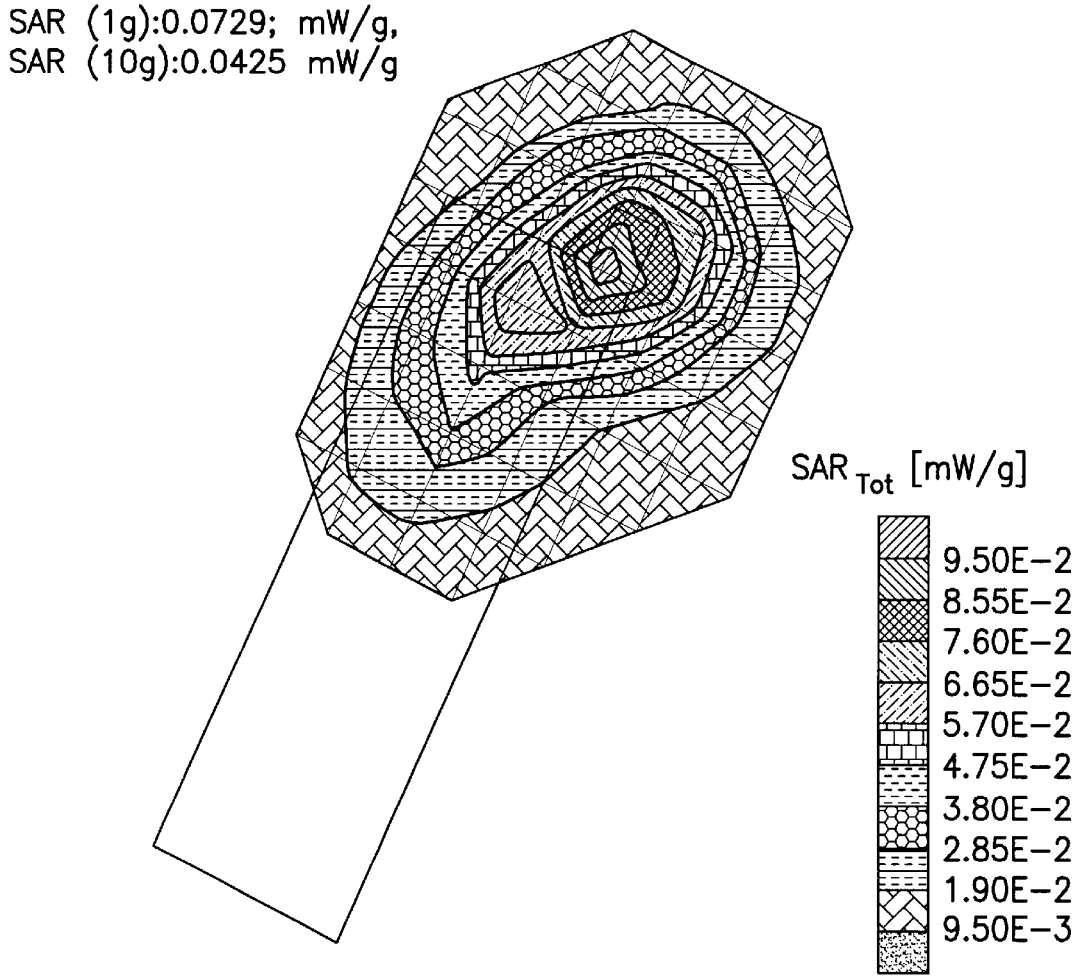
FIG. 7 illustrates the Specific Absorption Rate (SAR) for a Motorola StarTAC cellular telephone equipped with an antenna built in accordance with the present invention.

FIGS. 6 and 7 illustrate the SAR at locations on a Motorola StarTAC 7760 phone and compares SAR values for the phone equipped with a stock antenna to SAR values for the same phone equipped with an antenna constructed in accordance with the present invention. The Motorola StarTAC 7760 phone with the standard antenna had a SAR (1 g) of 0.747 mW/g and the phone with an antenna constructed in accordance with the present invention had a SAR (1 g) of 0.0729 mW/g.

The above data demonstrates that by use of an antenna constructed in accordance with the present invention, a user is able to obtain a substantial decrease in the amount of exposure to electromagnetic radiation caused by a cellular telephone antenna. This is accomplished without a significant reduction in signal strength. Therefore the performance of the phone is not significantly compromised. In general, the materials in accordance with the present invention are produced by providing the binder in a liquid form and mixing, preferably homogeneously therewith, the crushed crystalline material, the metalized or reflective flecks and any fluorescent material to be added. This material can then be used either in liquid form as a paint-on, spray-on or brush-on coating, or it may be hardened and shaped as appropriate for a particular application.

In the case of the antennas described above, for example, the material can be molded around a wire which acts as an antenna. After the wire is tooled, the binder is mixed with the crushed material, metalized or reflective flecks and any fluorescent material, poured into the mold and formed around the wire. Other molding techniques may be used.

Structures may also be imbedded (such as, for example, a magnet, a ball of mercury, a crystal or mechanical structures necessary for the operation of the antenna) by drilling space after the compound has set or cooled. The magnet may be fixed in place by filling the excess space with compound material or glue. The bulb of mercury may be added by providing the compound in a two-part mold around a cap or other member so as to leave a space for the mercury after the compound has been poured. Accordingly, the compound may include, in addition to materials previously described, excipients conventional in, for example, the plastic industry including, for example, hardeners, plasticisers, elastomeric agents, cross-linking promoters, polymerization or cross-linking initiators and the like. These would be used in amounts conventional for the plastics industry.

The materials in accordance with the present invention can be pre-formed into sheets, molded into housings or liners for housings, molded around electronic components such as, for example, an antenna, and formed into containers or the like. Accordingly, the formulations in accordance with the present invention can be used for reducing radiation from televisions, cordless phones, satellites, satellite dishes, transmission towers, cellular transmission towers, microwave towers, power lines, computers, computer-related accessories, microwave ovens, power plants, buildings and various housings, cases and molded parts.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention. For example, the antenna constructed in accordance with the present invention could be shorter or longer than that disclosed herein and the antenna could be tilted at angles of varying degrees to improve reception/transmission signals and to minimize electromagnetic radiation for the user. It is also foreseen that the density (thickness) of the resin could be altered (e.g., thicker or thinner). It is also foreseen that the antenna coil could be constructed of a metal other than copper, e.g., aluminum, steel or silver, or combinations thereof. It is also foreseen that the overall shape of the antenna could change depending on the various vibrational and frequency changes in cellular telephone technology. The construction of the antenna could be made to be flat so that it could fit inside a phone rather than outside as in antenna. It is also foreseen that instead of crushed crystal powder throughout the binder, a crystal chip with a programed frequency could be substituted. The crystal chip could be another semiprecious stone other than quartz crystal (e.g. tourmaline). Lastly, other fluorescent dyes may be utilized which have different colors which would be useful depending upon the type of electromagnetic radiation emission being treated.

What is claimed is:

1. An antenna for a cellular telephone, the antenna having a base end and a tip end, comprising:

a. a binder including crystalline powder and reflective flecks dispersed therein; and b. a conductive wire, having a first end and a second end, and extending from said base end to said tip end within said binder.

2. The antenna of claim 1, wherein said binder further comprises a fluorescent material.

3. The antenna of claim 1, further comprising a fluorescent dye distributed in said binder.

4. The antenna of claim 3, wherein said binder includes:

(a) 0.1% to 10.0% by weight crystal power;

(b) 0.1% to 10.0% by weight reflective flecks; and (c) 0.005% to 5.0% by weight fluorescent dye.

5. The antenna of claim 3, wherein said binder includes:

(a) 0.1% to 1.0% by weight crystal powder;

(b) 0.1% to 1.0% by weight reflective flecks; and (c) 0.005% to 0.02% by weight fluorescent dye.

6. The antenna of claim 3, wherein said binder includes:

(a) 0.2% by weight crystal powder;

(b) 0.3% by weight reflective flecks; and (c) 0.01% by weight fluorescent dye.

7. The antenna of claim 1, wherein said conductive wire comprises a coil of conductive wire extending within said binder.

8. The antenna of claim 1, further comprising a bulb of mercury proximate said first end of said conductive wire.

9. The antenna of claim 1, further comprising a magnet disposed adjacent said second end of said conductive wire.

10. The antenna of claim 9, wherein the magnet is disposed within the binder.

11. The antenna of claim 9, wherein said magnet comprises a cobalt-samarium magnet.

12. The antenna of claim 1, further comprising a quartz crystal disposed proximate said second end of said conductive wire.

13. The antenna of claim 12, wherein the quartz crystal is disposed within the binder.

14. The antenna of claim 1, wherein said conductive wire comprises a copper alloy.

15. The antenna of claim 1, wherein said reflective flecks comprise pieces of mylar having a metallic material disposed on surfaces thereof.

16. The antenna of claim 1, wherein said binder comprises a polymeric material.

17. The antenna of claim 1, wherein said binder is at least one of clear and transparent.

18. The antenna of claim 1, wherein said binder comprises water clear polyurethane.

19. The antenna of claim 1, wherein said crystal powder comprises quartz crystal powder.

20. An antenna for a cellular telephone, the antenna having a base end and a tip end, comprising:

a. a binder including reflective flecks dispersed therein;

b. a conductive wire, having a first end and a second end, and extending from said base end to said tip end within said binder; and c. a crystal.

21. The antenna of claim 20, wherein said binder further comprises a fluorescent material.

22. The antenna of claim 20 wherein the crystal is a quartz crystal.

23. The antenna of claim 20 wherein the crystal is disposed in said binder.

24. The antenna of claim 20 wherein the antenna has an SAR (1 g) of not more than 1.0 mW/g.

25. An antenna comprising a conductive wire and a binder, the antenna having an SAR (1 g) of not than 0.1 mW/g.

26. The antenna according to claim 25, wherein the SAR is not more than 0.0974 mW/g.

27. The antenna according to claim 25, wherein the SAR is in the range of about 0.729 mW/g to 0.0974 mW/g.

28. The antenna of claim 1 wherein the antenna has a SAR (1 g) of not more than 1.0 mW/g.

* * * * *